US005697414A

United States Patent [19]

Amburgey et al.

[11] Patent Number: 5,697,414

[45] Date of Patent: Dec. 16, 1997

[54] METHOD FOR PREVENTING AND/OR CONTROLLING STAINING IN LUMBER, APPARATUS THEREFORE AND NON-STAINED LUMBER

[75] Inventors: Terry L. Amburgey, Starkville; Shane C. Kitchens, Utica, both of Miss.

[73] Assignee: Mississippi State University, Mississippi State, Miss.

[21] Appl. No.: 437,371

[22] Filed: May 9, 1995

[51] Int. Cl.[6] ..... B27M 1/02

[52] U.S. Cl. ..... 144/361; 144/329; 144/359; 144/380

[58] Field of Search ..... 34/225; 144/329, 144/335, 361, 369, 2.1, 359, 380

[56] References Cited

U.S. PATENT DOCUMENTS

| | | | |
|---|---|---|---|
| 1,644,801 | 10/1927 | Van Der Werff | 144/361 |
| 2,666,463 | 1/1954 | Heritage | 144/361 |
| 4,051,882 | 10/1977 | Hasegawa | 144/369 |
| 5,480,679 | 1/1996 | Schmidt et al. | 144/335 |

*Primary Examiner*—W. Donald Bray

*Attorney, Agent, or Firm*—Oblon, Spivak, McClelland, Maier & Neustadt, P.C.

[57] ABSTRACT

Method and apparatus for providing control or elimination of non-microbial enzymatic staining in lumber sapwood. Stain resistant lumber obtained by application of mechanical force.

9 Claims, No Drawings

METHOD FOR PREVENTING AND/OR CONTROLLING STAINING IN LUMBER, APPARATUS THEREFORE AND NON-STAINED LUMBER

BACKGROUND OF THE INVENTION

1. Field of the Invention

The present invention relates to a method for preventing and/or controlling non-microbial staining in the sapwood of lumber, to an apparatus for carrying out the invention method, and to non-staining lumber, preferably non-staining lumber obtained by the invention method. The invention method applies mechanical force, preferably compression and/or vibration force, to the surface of freshly-cut lumber to prevent and/or reduce non-microbial sapwood staining. This non-chemical control method poses no threat to the environment, generates no hazardous waste and is easily incorporated into the green chain of existing lumber mills.

2. Discussion of the Background

Perhaps the major concern of the saw mill industry today is the production of lumber having the best possible appearance. Due to the inherent nature of wood, however, sapwood tends to discolor because of microbial and non-microbial staining. The staining leads to a loss in aesthetic quality and results in the degradation (both physical degradation and "degrading" as that term is used in the lumber industry to denote a lowering in wood quality grade and commercial value) of lumber from many tree species. Red Oak (*Quercus spp.*) and Ash (*Fraxinus spp.*) suffer the largest monetary losses due to staining, but losses also occur in other hardwood and softwood species. In fact, it currently is estimated that in the state of Mississippi alone, non-microbial enzymatic staining costs mill owners approximately twenty million dollars annually.

While it has been determined that microbial staining can be controlled through proper drying techniques and through the use of biocides (i.e., dip treatment of unseasoned lumber, or the injection of biocides into wood under pressure to protect against decay from fungus and/or insects and producing "pressure-treated lumber"), non-microbial enzymatic staining has not been widely addressed. Recently, however, one of the present inventors (Amburgey) and Schmidt determined that non-microbial staining in sapwood is caused by enzymes and/or chemical precursors of stain compounds produced by parenchyma cells present in the wood. See U.S. Ser. No. 08/056,685; University of Minnesota Docket No. 93065, filed Apr. 30, 1993 incorporated herein by reference.

Parenchyma cells in wood release enzymes and/or chemical precursors of wood stain compounds which eventually provide a discoloration of the sapwood. Often, the staining is non-uniform, mottled and has a gray appearance on the flat-sawn surface, making the wood unsuitable for many applications and causing the lumber to be assigned a low grade and to be sold for a lower price. Such non-microbial enzymatic staining tends to discolor the entire sapwood when observed in transverse section, as opposed to microbial (fungal) staining which forms wedge-shaped patches along rays. In the beginning stages, non-microbial enzymatic staining often appears at the heartwood-sapwood interface and later progresses throughout the available sapwood. Generally, the stain is not noticeable in rough-sawn lumber until the outer surface is removed by planing or sanding or a fresh cross-section is exposed by end trimming.

The prevention of non-microbial enzymatic staining has been accomplished chemically. For example, the treatment of lumber with sodium bisulfite has prevented the formation of non-microbial enzymatic staining. See Amburgey, T. L., P. Forsyth, 1987. Prevention and control of gray stain in southern red oak sapwood. In: Proc., 15th Annual Hardwood Symposium of the Hardwood Research Council, Memphis, Tenn. May 10–12, 1987, pp. 92–99; Forsyth, P. 1988, Control of non-microbial sapstains in southern red oak, hackberry, and ash lumber during air-seasoning. A thesis submitted to the Faculty of Mississippi State University in partial fulfillment of the requirements for the Degree of Master of Science in the Department of Wood Science and Technology, Mississippi State, Mississippi, pp. 1–50; Forsyth, P. G., T. L. Amburgey, 1991, Microscopic characterization of non-microbial gray sapstain in southern hardwood lumber. Wood and Fiber Sci. 23(3): 376–383; Forsyth, P. G., T. L. Amburgey, 1992, Prevention of non-microbial sapstains in southern hardwoods; Forest Prod. J. 42(3):35–40. The fumigation of logs with methylbromide has similarly prevented the development of non-microbial enzymatic stains. See Schmidt, E. L., T. L. Amburgey, 1994, Prevention of enzyme stain of hardwoods by log fumigation, Forest Prod. J. 44(5):32–34. However, because of the expense in handling, required line production changes and hazards presented by chemical treatment the commercial lumber industry has not adopted these chemically-based treatment processes.

SUMMARY OF THE INVENTION

Accordingly, one object of the present invention is to provide a novel method for the prevention and/or control of non-microbial enzymatic staining in sapwood which is commercially acceptable to the lumber industry and capable of being incorporated into current sawmill green chain operations.

Another object of the present invention is to provide a process for the control, reduction and/or prevention of non-microbial enzymatic sapwood staining which does not include treatment with chemical agents.

Another object of the present invention is to provide an apparatus for the production of lumber which is free from or has reduced level of non-microbial enzymatic staining.

Another object of the present invention is to provide various lumber products which are free of or have reduced levels of non-microbial enzymatic staining.

Other objects of the present invention and many of the attendant advantages thereof will be readily obtained as the same becomes better understood by reference to the following detailed description.

DETAILED DESCRIPTION OF THE PREFERRED EMBODIMENTS

The present invention method for preventing the non-microbial enzymatic staining of sapwood is based upon the application of mechanical force, (i.e., the application of force through mechanical means as opposed to gaseous means) preferably compression and/or vibration force to freshly-sawn (green) lumber. The mechanical force applied to the lumber is measured as pressure (force/area) and is referred to by the source of force. Generally, compression pressure, vibration pressure or a combination of compression and vibration pressure is applied to green lumber in an amount and for a time sufficient to prevent non-microbial enzymatic staining. Vibration, as that term is used herein, relates to the repetitious (at least 2×) application and removal of pressure within a relatively short time. Compression, as that term is used herein, relates to the steady or constant application of pressure over a relative long time. In each case (vibration and compression pressure) enough force is applied to green lumber for a time sufficient to inhibit the amount of non-microbial staining obtained as compared to wood which has not had such pressure applied thereto.

Generally, compression pressure can be applied to freshly-sawn lumber by pressure rollers, pressure plates, presses etc. A series of rollers, plates, presses etc. may be used for freshly-sawn lumber which is passing along a green chain to provide the desired dwell time for each board to be in contact with the pressure-applying device(s). Vibration pressure can be provided by pressure rollers, pressure plates, presses, etc., as well, but vibration pressure differs from compression pressure in that vibration pressure is applied for shorter periods of time than compression pressure and cycles between the application of pressure and release of pressure, as opposed to compression pressure which is relatively constant. A typical cycle time for the application of vibration pressure is from approximately 500 to 10,000, preferably about 5,000 cycles per minute. Vibration pressure can also be provided by air, hydraulic, vibration, etc. motors, ultrasonic waves, vibrating boxes or by the simple. mechanical hammering of freshly-sawn wood.

Preferred devices for the application of either compression or vibration pressure include a set of opposing pressure rollers, opposing pressure plates, a plate or impact (soil) tamper, an air vibration head, etc. The pressure-applying device(s) can be made of any material and preferably do not break or deform under the applied pressure. Preferably, the material used does not stain the wood being treated. For example, stainless steel is preferred over iron.

The invention method for preventing, reducing and/or controlling non-microbial enzymatic staining in freshly-sawn (i.e., green) wood can thus be accomplished by simply hammering green (i.e., lumber cut from unseasoned logs which is less than 4 weeks old) sapwood boards, applying sufficient pressure and number of blows to reduce or eliminate staining. More reproducible methods for reducing or preventing non-microbial enzymatic staining include the application of controlled amounts of pressure for controlled amounts of time, including the passage of freshly-sawn lumber to be treated through, e.g., a pair of compression rollers, etc. Vibration pressure may be applied by passing over the surface of the freshly-sawn lumber with a plate or impact tamper similar to those used in the construction industries for compacting soils, asphalt, etc. Further, freshly-sawn lumber to be treated may be simply placed in a press, and a sufficient amount of pressure can be applied for the necessary amount of time to reduce or eliminate non-enzymatic staining. The invention method does not work on dried wood.

The amount of pressure applied and time period during which pressure is applied varies with the lumber species being treated and its physical characteristics, including presence of knots, percent hardwood, etc. Since knots are typically extremely hard it can be difficult to apply pressure to the surrounding sapwood with a device designed to treat large pieces of flat lumber, and care must be taken in treating sapwood around knots with a relatively small pressure application device, such as a hammer, if such detail is required.

For typical pieces of lumber on commercial green chains the amount of pressure applied to reduce and/or eliminate non-microbial enzymatic sapwood staining varies from approximately 200 to 1800 psi, more preferably 400–1600 psi, most preferably 500–700 psi, for a time of between 0.1 seconds to 10 minutes, more preferably 30 seconds to 2 minutes. For an 8 foot board passing through a roller it is passed preferably at a rate of 1–10 seconds per foot. All pressures and times between the broadest ranges specified above are explicitly included herein, as are all ranges therebetween. Any amount of mechanical force applied to freshly-sawn lumber (i.e., mechanical pressure) for a time sufficient to reduce or prevent non-microbial enzymatic staining in the sapwood thereof for at least two weeks as compared to lumber which has not been so treated falls within the scope of the invention method. Preferably, the green lumber is treated on at least one surface thereof, meaning that at least 10%, preferably 50% more preferably 75%, most preferably at least 90% of the surface area of at least one surface of the subject piece of lumber has been treated according to the invention method and is resistant to non-microbial enzymatic staining.

The present invention apparatus for controlling, reducing and/or preventing non-microbial enzymatic sapwood staining includes any apparatus capable of providing sufficient mechanical pressure for a sufficient time to freshly-sawn lumber so as to prevent enzymatic sapwood staining. A preferred apparatus is a continuous one wherein a piece of lumber is passed through while having sufficient pressure applied to at least one surface thereof for the right amount of time. Such an apparatus preferably has one, more preferably two or more, "live" rollers, meaning rollers which are driven by a motor, etc. and which pull or push the piece of lumber through the apparatus. These live rollers may, optionally, also apply pressure, either compression or vibration pressure. While two opposing pressure rollers are preferred a single pressure roller may be used if only one side of the piece of lumber is to be treated. Devices Which apply compression or vibration pressure can be arranged to treat freshly-sawn lumber on one or more sides thereof, including all sides thereof, and this may be accomplished, if desired, by a single passage through an apparatus having one or several devices which apply compression and/or vibration pressure arranged in series.

The pressure-applying devices in the invention apparatus include rollers having an internal vibration device which are capable of applying both compression pressure (i.e., a certain constant pressure) and vibration pressure (i.e., the repeated transient application and removal of pressure). Such rollers are termed compression/vibration rollers and operate in either mode. Pressure-applying devices should be made of a material which does not stain lumber (i.e., stainless steel) for best results. The pressure-applying device (s) can be heated to increase the plasticity of the wood and the moisture flow therethrough. It has been found that when infeed and outfeed rollers with small abrasions are used the lumber flows through the invention apparatus smoothly due to the push and pull of the live rollers.

A preferred apparatus according to the present invention is one termed a compression-vibration machine (CVM) which provides a continuous path having infeed rollers with small abrasions, and a series of alternating compression rollers and compression/vibration rollers (preferably three of each applying about 600 psi each) and an outfeed roller with small abrasions, a plate tamper providing vibrations and a vibrating conveyor that moves lumber along by vibrating arranged in series wherein the term "roller" as used in this description of the CVM refers to a set of top and bottom opposed rollers, the compression/vibration rollers operating in a vibrating mode (preferably at about 4700 cycles/minute). Appropriate bearings, shields, cylinders, power sources, pressure controls, electrical controls, etc., all well within the skill of the ordinary artisan are provided for operation. The apparatus according to the present invention can be much more simple in design, however: a single compression roller situated atop a bench through which the operator pushes a piece of lumber, one or more times, for example.

Preferred rollers are stainless steel rollers having diameters of from 1–12 inches, preferably approximately 6 inches in diameter. Preferably, the pressure-applying device(s) have the same or greater width as the freshly-sawn lumber being treated, and where two opposed pressure devices are being used to treat two sides of a piece of lumber simultaneously, for example two opposed compression rollers, it is preferred that each roller provide the same pressure on each side of the piece of lumber, although this is not required.

Of course, certain additions and modifications to the invention apparatus can be present, such as an electric eye to measure board size and activate the positioning of pressure-applying devices downstream. It is emphasized, however, that the apparatus according to the present invention can be extremely simple in design, and an apparatus having only a single roller has provided acceptable results for, eg., an 8 foot board one inch thick passed through the single roller five times, each pass taking 10 seconds, the roller applying a pressure of approximately 600 psi. Additionally, acceptable results have been obtained by vibrating a soil tamper on top of freshly-sawn lumber.

The present invention also relates to lumber, preferably green lumber, which has no or reduced non-microbial enzymatic sapwood staining as compared to untreated lumber. The lumber according to the present invention has preferably been treated while green with the vibration and/or compression pressure method described above and preferably has at least 30%, more preferably 60%, most preferably at least 80% less non-microbial enzymatic staining of the sapwood therein as compared to a piece of the same type of lumber which has not been treated for non-microbial enzymatic staining. The lumber according to the present invention is distinguished from lumber which has been dried (for example, kiln dried) and then hit with a hammer while nailing since such seasoned lumber would not be discolored by non-microbial enzymatic stains even if not struck by a hammer.

EXAMPLES

The present invention will now be further explained by reference to the following Examples. The invention is not limited to these Examples, however.

The term "control" as used herein refers to a reduction in the graying obtained due to non-microbial enzymatic staining as compared to a non-treated sample (measured visually—28 days after treating by planing or exposing a fresh end by cross-cutting.)

1. Red oak (4/4×varying width×4 feet long) samples labeled A1–A6 were subjected to vibration pressure provided by a gas operated plate tamper of approximately 100 lbs and having an approximately 0.4 sq. ft. plate. The boards were placed two at a time on a concrete surface and the plate tamper was run over them. The following list shows treatment performed and the results obtained.

A1—The sample was treated on both surfaces with one pass of tamper

—Control was obtained throughout the sample where force was maximum

A2—The sample was treated on both surfaces with one pass of tamper

—Control was obtained in spots along the length of board

A3—The sample was treated on both surfaces with two passes of tamper

—Control was obtained throughout the sample where force was maximum

A4—The sample was treated on both surfaces with two passes of tamper

—Control obtained in spots

A5—The sample was treated on both surfaces with three passes of tamper

—100% control obtained except around knot

A6—The sample was treated on both surfaces with three passes of tamper

—Control ¾ of the way through thickness on one side and spotty control on the other surface 2. Red oak (4/4×varying widths×4 feet long samples) labeled B1–B8 were treated by passing them through a set of compression rollers providing approximately 600 psi on each side. The samples were run through the rollers a different number of times to simulate different dwell times.

B1—The sample was treated with one pass through rollers

—Spotty control

B2—The sample was treated with two passes

—Spotty complete control along length of board

B3—The sample was treated with three passes

—100% control except around knots

B4—The sample was treated with four passes

—100% control along length of board

B5—The sample was treated with five passes

—100% control except around knot

B6—The sample was treated with six passes

—100% control

B7—The sample was treated with six passes

—few spots of control (similar to sample B1).

This board had a large percentage of heartwood

B8—The sample was treated with six passes

—90% control

All samples with spotty control had a large percentage of heartwood or several knots.

3. Red oak (4/4×varying widths×4 feet long) samples labeled C1–C6 were treated using the plate tamper as used on samples A1–A6.

C1—The sample was treated on one surface with one pass of tamper

—control within ⅛", of surface where vibration was maximum

C2—The sample was treated on two surfaces with two passes of tamper

—Complete control where force was maximum

C3—The sample was treated on two surfaces with two passes of tamper

—Complete control where force was maximum

C4—The sample was treated on one surface with one pass of tamper

—Very spotty control

C5—The sample was treated on one surface with three passes of tamper

—Complete control where force was maximum except around knot

C6—The sample was treated on one surface with three passes of tamper

—Complete control where force was maximum except around knot

4. Some of the following red oak (4/4/×varying width×4 feet long) samples were treated using only a plywood press (compression source). Other samples were treated with the plywood press for the compression source and then the tamper used in Samples A1–A6 for a vibration source of pressure. The time is for press time.

| Sample | BoardWidth | Time (min) | Press Gauge Pressure | Tamper |
|---|---|---|---|---|
| D1 | 2.5" | .50 | 600 | 2S1P |
| D2 | 3.0 | 1.00 | " | 2S1P |
| D3 | 2.75 | 2.50 | " | 2S2P |
| D4 | 4.0 | 2.30 | " | 2S2P |
| D5 | 5.0 | 3.00 | " | 2S3P |
| D6 | 6.25 | 4.00 | " | 2S3P |
| D7 | 2.75 | .50 | " | |
| D8 | 4.25 | 1.00 | " | |
| D9 | 3.5 | 2.00 | " | |
| D10 | 4.25 | 2.50 | " | |
| D11 | 5.5 | 3.00 | " | |
| D12 | 6.0 | 4.00 | " | |

2SIP = two surfaces treated with one pass of tamper; 2S2P is two surfaces treated with two passes of tamper
D1 - Spotty complete control in areas extending from the press and spotty complete control within press area
D2 - Spotty areas of complete control and other areas with control ½ the thickness of the lumber
D3 - Outside of press area was clean (100% control) and spotty areas of control within press area
D4 - Spotty areas within and outside press area, sapstain around knot
D5 - Very little control, sample was mainly heartwood with nine knots in a 4" piece
D6 - Complete control over 95% of the board
D7 - 100% control outside press areas except around knot, control through ¾ of thickness in pressed area
D8 - Areas of complete control inside and outside press area, no control around knot
D9 - Very little control, board 90% heartwood
D19 - Areas of complete control within and outside pressed areas, board 80% heartwood
D11 - Nearly 100% control within and outside pressed areas
D12 - Areas of complete control within and outside pressed areas It was noticed that areas outside the press area had signs of complete control. It is possible that the "juices" being forced out of the wood had some effect on shutting down the enzymes in the parenchyma cells which cause the non-microbial stain.

Samples which contained a large % of heartwood and samples which contained large amounts of knots had signs of very little or spotty control: there is a correlation between the % of heartwood and knots and the % of control due to the inability to compress and vibrate these areas. The plate tamper appeared to control the stain in areas where maximum force was applied. The tamper "jumped" around on the samples, however, not giving maximum control over the entire piece of wood.

The application of oxalic acid on some of the samples where discoloration was present removed the discoloration. This test determines the stain to be non-microbial. Due to the stain being present mainly on the surface of the samples where contact with iron was made, the majority of the discoloration was iron stain rather than non-microbial enzymatic stain.

A fourth test was run on the mechanical control of non-microbial sapstain. The materials used for the test were red oak and hackberry lumber ¾"×varying widths× 4'. After being treated and air dried, the samples were planed taking approximately 1/32" off the surface. The samples were evaluated after discarding six inches on each end of the board. The staining present in many of the samples was at the surface and did not penetrate deeply into the sample. Since iron tannate stain was present an iron stain remover was added to remove the iron in order to properly evaluate the samples.

Samples labeled RP11–RP72 and HP11–HP72 were put in a plywood press for different dwell times. The gauge pressure was set at 600 psi for all samples

| Sample # | | Time (min) | % Control R.O. | | % Control Hackberry | |
|---|---|---|---|---|---|---|
| RP11 | HP11 | .50 | *100 | **70 | *30 | **5 |
| RP12 | HP12 | .50 | 100 | 80 | 40 | 50 |
| RP21 | HP21 | 1.00 | 80 | 70 | 0 | 5 |
| RP22 | HP22 | 1.09 | 90 | 95 | 80 | 80 |
| RP31 | HP31 | 2.00 | 100 | 90 | 0 | 5 |
| RP32 | HP32 | 2.00 | 100 | 100 | 80 | 60 |
| RP41 | HP41 | 2.50 | 100 | 100 | 75 | 60 |
| RP42 | HP42 | 2.50 | 100 | 100 | 60 | 60 |
| RP51 | HP51 | 3.00 | 70 | 90 | 50 | 60 |
| RP52 | HP52 | 3.00 | 80 | 100 | 15 | 5 |
| RP61 | HP61 | 4.00 | 95 | 85 | 65 | 50 |
| RP62 | HP62 | 4.00 | 65 | 80 | 90 | 80 |
| RP71 | HP71 | 5.00 | 30 | 80 | 50 | 30 |
| RP72 | HP72 | 5.00 | 30 | 15 | 90 | 60 |

*Indicates percent control within press area
**Indicates percent control outside the press area
Note:
Where knots were present the presence of stain was greater than in areas without knots present. This explains the variations in % control.
2. Red oak and hackberry (4/4 × varying widths × 4 feet long) lumber was run through a compression/vibration machine. This machine is the CVM machine described above where the rollers applied approximately 600 psi pressure and the plate tamper is that used on Samples A1–A6. Replicate samples were used.

| Sample # (2 replicates per species) | | Treatment | % Control R.O. | | % Control Hackberry | |
|---|---|---|---|---|---|---|
| R1 R12 | H1 H12 | (1 pass 1 side) | 60 | 75 | 80 | 60 |
| R2 R22 | H2 H22 | (2 passes 1 side) | 90 | 95 | 20 | 5 |
| R3 R32 | H3 H32 | (3 passes 1 side) | 100 | 75 | 20 | 40 |
| R4 R42 | H4 H42 | (4 passes 1 side) | 100 | 95 | 10 | 60 |
| R5 R52 | H5 H52 | (5 passes 1 side) | 70 | 100 | 40 | 70 |
| R6 R62 | H6 H62 | (1 pass 2 sides) | 80 | 42 | 10 | 15 |
| R7 R72 | H7 H72 | (2 passes 2 sides) | 75 | 100 | 10 | 50 |
| R8 R82 | H8 H82 | (3 passes 2 sides) | 50 | 95 | 5 | 30 |
| R9 R92 | H9 H92 | (4 passes 2 sides) | 50 | 5 | 30 | 80 |
| R10 R102 | H10 H102 | (5 passes 2 sides) | 80 | 0 | 60 | 10 |

Red oak and hackberry ¾×varying widths×4 feet long lumber was passed one time through compression rollers (600 psi) and subjected to the vibration tamper used for A1–A6 up to 5 times. The samples labeled RCT1–RCT52 and HCT1–HCT52.

| Sample #* (2 replicates per species) | | | | % Control R.O. | | % Control Hackberry | |
|---|---|---|---|---|---|---|---|
| RCT1 | RCT12 | HCT1 | HCT12 | 5 | 10 | 0 | 40 |
| 2 | 22 | 2 | 22 | 40 | 95 | 30 | 5 |
| 3 | 32 | 3 | 32 | 80 | 65 | 0 | 70 |
| 4 | 42 | 4 | 42 | 40 | 30 | 0 | 5 |
| 5 | 52 | 5 | 52 | 15 | 10 | 20 | 10 |

*Tamped 1 to 5 times on one side of each board

What is claimed as new and desired to be secured by Letters Patent of the United States is:

1. A method for controlling or preventing non-microbial staining in the sapwood of a piece of lumber which is susceptible to such staining, comprising the step of applying mechanical force to green lumber for a time and at a pressure sufficient to reduce or eliminate said non-microbial staining.

2. The method as claimed in claim 1, wherein said mechanical force is compression force and/or vibration force.

3. The method as claimed in claim 1, wherein said mechanical force is applied to said green lumber at a pressure of from 200 to 1800 psi.

4. The method as claimed in claim 3, wherein said force is applied to said green lumber for a total time of from 0.1 seconds to 10 minutes.

5. The method as claimed in claim 1, wherein said; mechanical force is applied to said green lumber by a compression roller.

6. The method as claimed in claim 1, wherein said mechanical force is applied to said green lumber by a press.

7. The method of claim 1, wherein said mechanical force is applied to said green lumber by compression and vibration.

8. The method of claim 1, wherein said method does not include treatment of said green lumber with a chemical agent.

9. The method of claim 1, further comprising drying said green lumber after the application of mechanical force.

* * * * *

UNITED STATES PATENT AND TRADEMARK OFFICE

CERTIFICATE OF CORRECTION

PATENT NO. : 5,697,414
DATED : December 16, 1997
INVENTOR(S) : Terry L. Amburgey et al.

It is certified that error appears in the above-identified patent and that said Letters Patent is hereby corrected as shown below:

Title page,
Before the "References Cited" section, please insert the following:

-- This invention was made with U.S. Government support under Contract Number 93-34158-8349 awarded by the Department of Agriculture. The U.S. Government may have certain rights in this invention. --

Signed and Sealed this

Fourth Day of February, 2003

JAMES E. ROGAN
*Director of the United States Patent and Trademark Office*